US005092573A

United States Patent [19]

Abreu

[11] Patent Number: 5,092,573

[45] Date of Patent: Mar. 3, 1992

[54] AUXILIARY PAPER FEEDING APPARATUS FOR HIGH SPEED COMPUTER PRINTERS

[76] Inventor: Michael L. Abreu, 16603 Clovermead St., Covina, Calif. 91722

[21] Appl. No.: 578,089

[22] Filed: Sep. 5, 1990

[51] Int. Cl.[5] ..... B41L 1/32

[52] U.S. Cl. ..... 270/52; 270/39; 156/502; 156/505; 226/197

[58] Field of Search ..... 270/32, 52, 39; 156/502, 504, 505, 506, 507, 508, 509, 157; 226/7, 97, 197

[56] References Cited

U.S. PATENT DOCUMENTS

| | | | |
|---|---|---|---|
| 3,776,795 | 12/1973 | Stevenson | 156/505 |
| 3,954,213 | 5/1976 | Andersen | 226/7 |
| 4,252,597 | 2/1981 | Monroe | 270/52 |
| 4,390,389 | 6/1983 | Bunas | 156/502 |
| 4,421,590 | 12/1983 | Meschi | 156/506 |
| 4,492,328 | 1/1985 | Munnich | 226/197 |
| 4,564,184 | 1/1986 | Rumpel | 270/39 |

FOREIGN PATENT DOCUMENTS

| | | | |
|---|---|---|---|
| 718782 | 9/1965 | Canada | 226/197 |
| 145058 | 7/1986 | Japan | 156/505 |
| 1070201 | 6/1967 | United Kingdom | 226/197 |

*Primary Examiner*—John T. Kwon
*Assistant Examiner*—Therese M. Newholm
*Attorney, Agent, or Firm*—H. R. Lambert; A. H. Thompson

[57] ABSTRACT

An auxiliary paper feeding apparatus is provided for feeding a continuous web of fan-fold paper from one or more serially-arranged stacks of paper into a printer. A plurality of elongate, slender turn bars are non-rotatably mounted to the frame for causing a web of paper from a source to change direction as required to feed the web of paper from the outside paper source through the access opening and into the paper storage and feeding region of the printer and into the paper feed mechanism. Each turn bar is hollow and has a number of holes through the side wall. An air pump supplies pressurized air to each of the turn bars so that the flow of air out through the holes forms an air cushion over which the web of paper passes, thereby reducing frictional drag on the paper web and enabling the printer paper drive mechanism to be the sole motive power for advancing the paper web. A paper edge guide is provided which also employs an air cushion to reduce paper friction. An associated conveyor is provided for serially conveying stacks of fan-fold paper to a pick-up position from which paper is routed to the turn bars on the frame. A paper splicer, having a vacuum-operated splicing tape hold down is provided for splicing adjacent end sheets of the stacks of paper together to form the web.

30 Claims, 4 Drawing Sheets

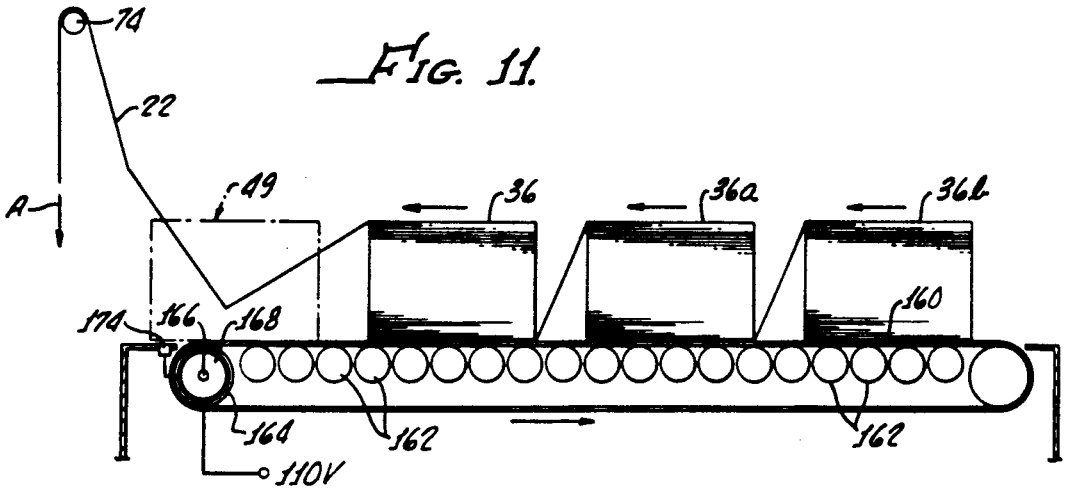
FIG. 11.
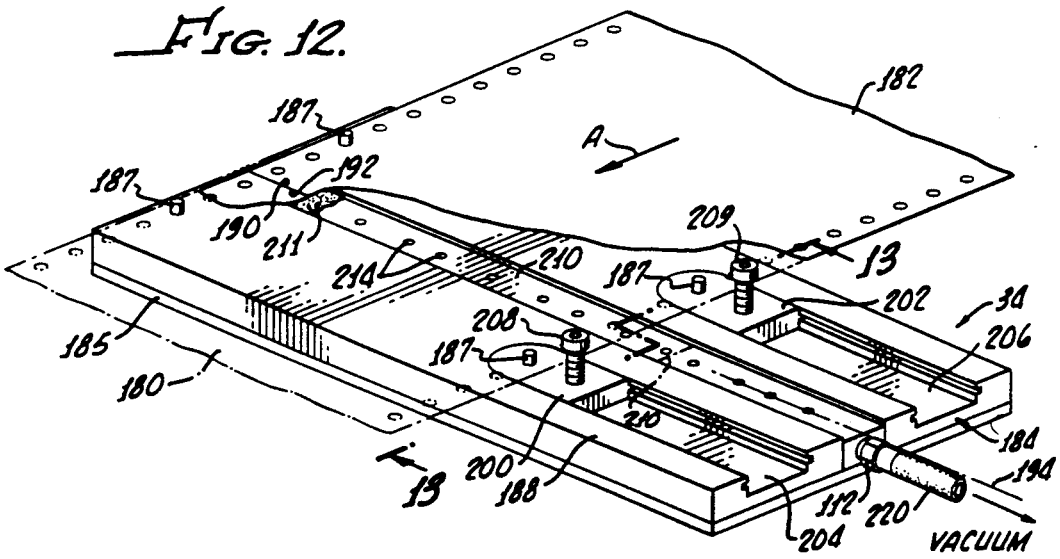
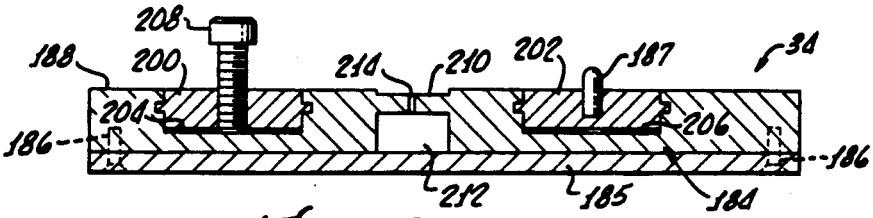
FIG. 13.

AUXILIARY PAPER FEEDING APPARATUS FOR HIGH SPEED COMPUTER PRINTERS

BACKGROUND OF THE INVENTION

1. Field of the Invention

The present invention relates generally to the field of paper feeding apparatus for printers, and, more particularly, to apparatus for feeding a continuous web of fan-fold paper to high speed commercial printers, such as computer-driven laser printers.

2. Background Discussion

High speed laser printers capable of utilizing fan-fold, pin-feed forms are often used to process large quantities of information from a computer to printed forms. Banks, large medical facilities, investment houses, universities, and governmental agencies are typical users of these high speed, complex, and costly printing systems. The IBM 3800, Siemens 2200 and 2300, Storage Technology 6100, Unysis 0777, and Datagraphix 9800 are examples of such printers used in these print-intensive data centers when both print quality and speed are required. These printers have paper feed rates of either 100 or 200 feet per minute, (depending on the model) and can provide the highest through-put potential available today.

However the through-put potential of these printers cannot be completely realized because the paper storage bin, from which the fan-fold paper is supplied to the printer is recessed within the printer and will accept only one stack (about 2000 sheets) of fan-fold computer paper. During operation of the printer, this paper is automatically fed upwardly from the paper bin into and through the printing portion of the printer by a tractor drive mechanism. When the stack of paper of depleted, the print processing stops until another stack of paper is loaded into the paper bin and spliced onto the tail portion of the just-used stack. The printer down-time for such paper loading and splicing is typically about 4–5 minutes, or more, depending on when the operator can free himself or herself from other important tasks.

It can readily be calculated that a printer that prints at the rate of 200 feet per minute will deplete a 2000 sheet stack of paper in about 10 minutes. Thus the printer down-time for loading and splicing paper represents at least about 30 percent loss in potential through-put of the printer.

Moreover, to minimize such printer down-time, an operator must be at stand-by when the paper supply in the printer paper bin is running low so as to be immediately ready to load and splice in another stack. Thus data center functions are distrupted and operator efficiency is reduced.

In addition, these printers cost about $300,000 each; therefore, this paper replenishing down-line represents a considerable waste not only of printing time but of capital expenditures, the latter because it takes four printers to do the work which three could do if paper replenishing down-line could be eliminated or substantially reduced.

For the above-mentioned reasons, as well as other reasons, attempts have been made to provide auxiliary paper feeding apparatus for feeding a continuous web of fan-fold computer paper from a source of paper outside the printer to the normal paper feeding regions within the printer. By so providing, the splicing of one stack of forms to another can be accomplished while the printer is running, thereby eliminating the costly down-time described above. Exemplary of such auxiliary paper feeding apparatus are those disclosed in U.S. Patent No. Re. 31,210 to Lapp, et al.; U.S. Pat. No. 4,848,634 to Crowley, et al.; U.S. Pat. No. 4,564,184 to Rumpel; and U.S. Pat. No. 4,813,357 to Ward, et al.

As can be readily appreciated, the type of paper web routing required by such disclosed auxiliary paper feeding apparatus in and of itself presents serious paper feeding and control problems. In order to feed a continuous web of paper from an external paper source region, the auxiliary paper feeder must provide a means by which the web is made to change direction several times. To accomplish this, a series of turn bars can be arranged so as to deflect and redirect the flow of paper from the external source into the tractor drive mechanism of the associated printer.

A problem, however, exists with the use of stationary turn bars. The problem is that as the web of paper is redirected and comes into contact with the turn bars, there results a significant and often substantial drag on the paper. In some instances this drag on the paper web may be great enough to tear apart adjacent sheets of paper, thereby disrupting the paper feeding operation until the torn-apart sheets are spliced back together. Consequently, auxiliary paper feeding apparatus for high speed laser printers are known to use rotatably-driven turn bars as well as stationary turn bars so as to reduce the drag on the paper web as it changes direction over these turn bars.

One known example of such hybrid paper feeding apparatus utilizing both stationary and rotatably-driven turn bars is disclosed in the above-mentioned Lapp, et al., reissue patent. The auxiliary paper feeding apparatus as described therein is constructed for causing the moving web of paper to change direction four times by use of two stationary turn bars and two rotatably-driven turn bars.

However the providing of power-driven turn bars does not solve all the problems associated with reliably feeding a continuous web of fan-fold paper from an auxiliary feeder into an associated high sped printer. The drive belts used to drive the power-driven rollers are, for example, are a constant source of problems. For reliable performance, these belts must be adjusted when they become worn and loose and must be replaced when broken. Still further, the bearings used in the power-driven turn bars require periodic maintenance. Even further, the exposed power-driven turn bars and rollers present a work hazard to operators whose loose clothing, hair or fingers may become entangled in the drive belts or between the rotating turn bars and their associated paper guide plates.

Therefore, it would be desirable to provide a method and apparatus to guide a continuous web of paper from an external paper source to the normal feed path inside a printer without the use of power-driven turn bars so as to eliminate the maintenance, safety and performance problems associated with that tension (i.e., drag) reducing method.

Another problem typically encountered in any of the above-described printers and/or auxiliary paper feeders is the necessity for accurately splicing the top sheet of a fresh stack of forms to the tail end of the just-used stack. Such splices must be made carefully because they are critical to good printer performance. If a paper jam results from a poor paper splice, printer processing is disrupted, all pieces of the damaged form must be carefully removed from the printer and a new splice must be made.

Yet another problem with existing high speed printers of the type discussed above is that the splicing and threading of fresh stacks of forms must take in the recessed paper storage region of the printers. Personnel performing these tasks are required to work in cramped and awkward quarters, thereby increasing the chances for a poor splice.

For the above-mentioned reasons and others, it is desirable for any auxiliary paper feeding apparatus to provide an associated splicing method and apparatus for quick, accurate splicing of one stack of paper to another at an easily accessed, external paper source region.

It is, therefore, a principal objective of the present invention to provide an auxiliary feeding apparatus for feeding a continuous web of paper, especially fan-fold paper, to high speed computer printers, such as laser printers, and which employs turn bars which provide minimum drag on the web of paper changing the direction of travel thereover without using free-wheeling or power-driven rollers and turn bars. It is another objective of the present invention to provide for automatic feeding of stacks of paper to be fed into the associated printer and to provide easy means for splicing the leading end of one stack of paper to the tail end of the preceding stack of paper so as to maintain a continuous feeding of paper into an associated printer.

SUMMARY OF THE INVENTION

In accordance with the present invention, there is provided an auxiliary paper feeding apparatus for feeding a web of paper, especially fan-fold paper, to preexisting large, commercial types of computer printers which have an internal paper storage or holding and a paper feed region and having an associated paper drive mechanism and further having an access opening from the outside into the paper holding and feed region. The paper feeding apparatus comprises a turn bar frame having one end region adapted for being positioned through the access opening and into the paper storage and feed region of the printer while other portions of the turn bar frame remain outside of the access opening.

The apparatus includes at least two elongate, slender turn bars mounted, preferably, non-rotatably mounted, to the turn bar frame for causing a web of paper from a source of paper outside of the printer to change direction as required to feed the web of paper from the outside paper source through the access opening and into the paper storage and feed region of the printer and into the paper drive mechanism. At least one of the turn bars is tubular in configuration and is formed having a number of holes or openings through the sidewall thereof in regions over which the web of paper passes to change direction. Further comprising the apparatus are a source of pressurized air (or other gas) and means for providing pressurized air from the pressurized air source to the inside of the at least one tubular turn bar with sidewall holes so as to provide a flow of pressurized air outwardly through the holes. In this manner, a cushion of air is provided between the outside of the turn bar and a web of paper changing direction thereover.

According to a preferred embodiment of the invention, the auxiliary paper feeding apparatus includes two turn bars which are mounted to the turn bar frame at the same inclined angle and in a common plane for causing a web of paper traveling thereacross to travel sidewardly through the access opening and into the paper storage and feed region of the printer. Preferably, the two inclined turn bars are laterally spaced apart from one another and each is formed in a tubular configuration with a number of holes formed through the sidewalls thereof in regions over which the web of paper passes to change direction. Correspondingly, the means for supplying pressurized air supplies pressurized air to each of the two inclined turn bars.

It is further preferred that the paper feeding appartus of the present invention includes paper edge guiding means disposed intermediate the two inclined turn bars for supporting the lower edge of a web of paper traveling between the two turn bars. Ideally, the edge guiding means include an elongate channel defining a longitudinal opening through which the lower edge of the paper web passes. The channel is preferably hollow and is formed having a number of holes in the inner sidewalls thereof to the longitudinal opening, the pressurized air supply means being connected for supplying pressurized air to the inside of the channel so as to provide a flow of pressurized air outwardly through the sidewall holes into the longitudinal opening to thereby provide an air cushion for the web of paper traveling through the channel. Means are included for adjusting the height of the edge guiding means so as to accommodate the apparatus for the use of paper webs of different widths.

In the preferred embodiment, the web of paper comprises paper from a stack of fan-fold computer paper and the auxiliary paper feeding apparatus includes conveyor means for holding a plurality of stacks of fan-fold paper from which the web of paper is obtained. The conveyor means include a conveyor for serially moving the stacks of paper, one at a time, to a paper pickup position from which the paper is picked up for traveling across the turn bars and into the printer paper storage and feed region, preferably being pulled from the paper stack and across the turn bars by the preexisting paper drive in the printer. Conveyor drive and control means are preferably included for causing the conveyor to advance a next stack of paper to the pickup position in response to the last sheet of paper being picked up from the stack of paper already at the pickup position.

Advantageously, the auxiliary paper feeding apparatus also includes paper splicing means for splicing a last sheet of paper from one of the stacks of paper, for example, on the conveyor, to the first sheet of paper from a next in series stack of paper. According to the preferred embodiment, the paper splicing means include a plate having a plurality of pins along sides of the plate, the pins being spaced apart transversely and longitudinally for fitting into side holes of the last and first sheets of paper so as to hold the sheets in a position for being spliced together. It is preferred that the splicing means include means enabling the transverse distance between the pins to be adjusted to accommodate paper of different widths. To assist in the paper splicing, the plate includes means for retaining a strip of splicing tape in place along a splice line between the last and first sheet of paper to enable the taping together thereof. The tape retaining means may comprise a hollow region of said plate, this region being formed having a series of holes along the splice line. In such case, means are included for providing a vacuum to the hollow region of the plate for causing a strip of paper splicing tape placed along the splice line to be held by the vacuum to the plate. To help hold the splicing tape along the splice line, the plate may be formed having a recess along the splice line for receiving a strip of splicing tape.

It will be appreciated that for the maximum benefit the auxiliary paper feeding apparatus comprise the turn bar frame, the conveyor means and the paper splicing means, it is not required that all three of such major components be always used together. For example, in some installations, the turn bar frame may be used by itself with other types of available paper stack holding apparatus and other available types of paper splicing means. In other installations, the conveyor means may advantageously be used with other types of turn bar frames and other types of paper splicers. In still other situations, the paper splicing means may be used with other types of turn bar frames and paper stack loaders. Or, any two of the three major components may be used together to advantage in other types of auxiliary paper feeding assemblies.

BRIEF DESCRIPTION OF THE DRAWINGS

The present invention may be more readily understood by a consideration of the following detailed description when taken in conjunction with the accompanying FIGS. in which:

FIG. 11 is a partial, side elevational view taken along line 11—11 of FIG. 1, showing features of the paper stack conveyor portion of the auxiliary paper feeding apparatus, showing the manner in which the conveyor belt is driven and controlled;

FIG. 12 is perspective drawing of a vacuum supplied paper splicing portion of the auxiliary paper feeding apparatus showing a splicing plate having plurality of longitudinal and transversely spaced apart pins for holding abutting sheets of computer paper, showing the manner in which the transverse spacing of the pins can be varied so as to accept paper of different widths and showing a transverse groove in the plate along the splice line for holding a strip of splicing tape in the correct splicing position, the tape being held in place by a vacuum applied to the paper-holding groove through openings in the plate; and FIG. 13 is a transverse cross sectional drawing taken along line 13—13 of FIG. 12, showing the manner in which the paper splicing portion of the apparatus is constructed.

In the various FIGS. like elements and features are given the same reference numbers.

DESCRIPTION OF THE PREFERRED EMBODIMENT

Figure 1:
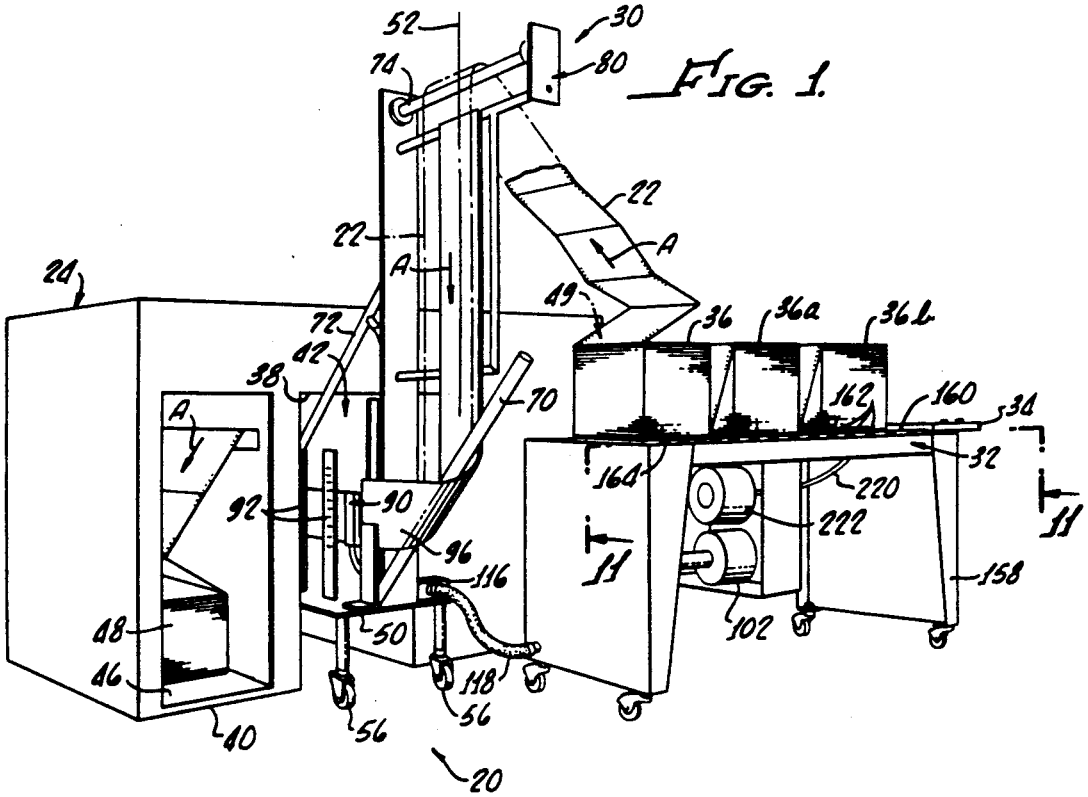
FIG. 1 is a perspective drawing showing the automated, auxiliary paper feeding apparatus of the present invention operatively installed in and with a conventional, preexisting high speed computer printer, and showing the general arrangement of the auxiliary paper feeding apparatus, including a paper turn bar portion which routes a continuous web of paper from outside the printer through an access opening and into paper storage, drive and printing regions and showing an associated conveyor for holding stacks of fan-fold paper from which the continuous web of paper is drawn by the printer paper drive, over the turn bar portion of the apparatus.

As shown in FIG. 1, an auxiliary paper feeding apparatus 20 for feeding a continuous web of fan-fold computer paper 22 to an associated high speed computer printer 24 generally comprises a turn bar frame portion or means 30, a paper stack conveyor portion or means 32 and a paper splicer portion or means 34. As more particularly described below, the function of turn bar frame portion 30 is to guide paper web 22 from a paper stack 36 on conveyor portion 32 through an acess opening 38 in a face 40 of printer 24 into a paper holding and feeding region 42 of the printer (see also FIG. 2). Turn bar frame portion 30 enables the substantially frictionless advancing of paper web 22 from stack 36 in the conveyor pick-up position without providing any external driving of the paper web. That is, the only paper advancing power (other than that provided to advance stacks of paper 36, 36*a*, 36*b*, etc. on conveyor portion 32, is the paper driving provided by an existing paper drive mechanism 44 (shown in phantom lines in FIG. 2) in printer 24 above or in upper regions of paper storage and feeding region 42. Shown in FIG. 1 is a printed paper bin 46 in printer 24 for holding a stack 48 of fanfold paper after it has been printed by printer portions of printer 24. Printed paper can be quickly removed from printer bin 46 in a matter of seconds by tearing off paper stack 48 when the bin gets full.

The function of conveyor portion 32, which is more particularly described below, is to serially advance stacks of paper 36*a*, 36*b*, etc. to a paper pick-up position 49 at the down-stream end of conveyor portion adjacent to turn bar frame portion 30 as paper stack 36 at the paper pick up position is used up (that is, is completely moved through and onto the turn bar frame portion).

In turn, the function of paper splicing portion 34 (also more particularly described below) is to splice an end sheet of one paper stack 36, 36*a*, 36*b*, etc. to the first or beginning sheet of the next-in-series paper stack 36*a*, 36*b*, etc. In this manner, the paper in stack 36 is joined to the paper in stack 36*b* and the paper in stack 36*a* is joined to the paper in stack 36*b*, and so forth, to form continuous paper web 22 as stacks of paper are used up and as new stacks of paper are loaded onto conveyor portion 32. Accordingly, paper splicing portion 34 causes paper stacks 36, 36*a*, 36*b*, etc. to be formed into continuous paper web 22.

Figure 3:
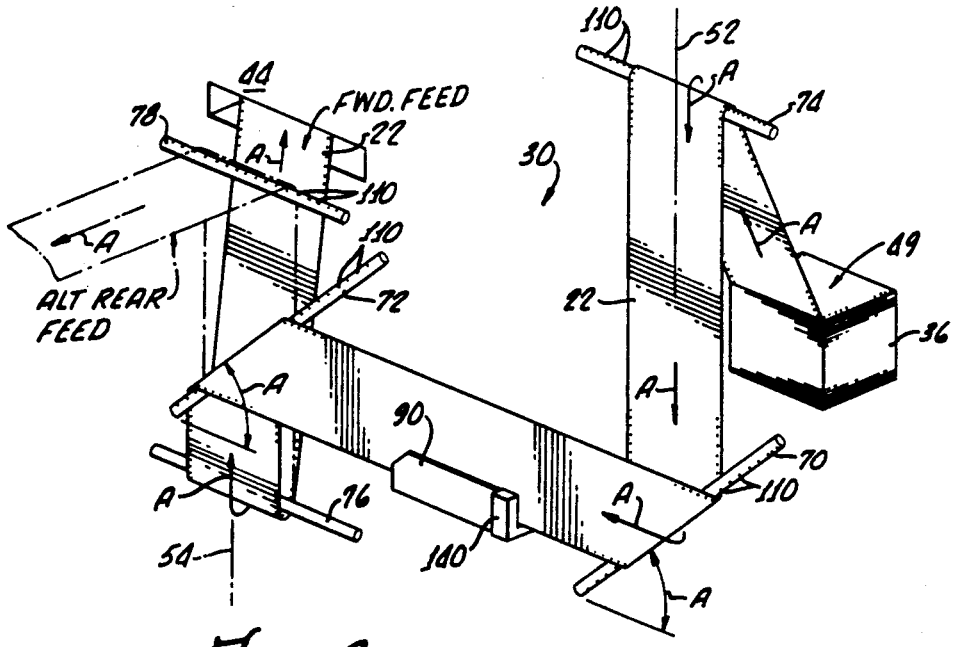
FIG. 3 is a pictorial perspective drawing showing the manner in which the web of paper is routed through the turn bar portion of the apparatus, an alternative, rear feed paper path, as may be required for some printers, being shown in phantom lines.
Figure 2:
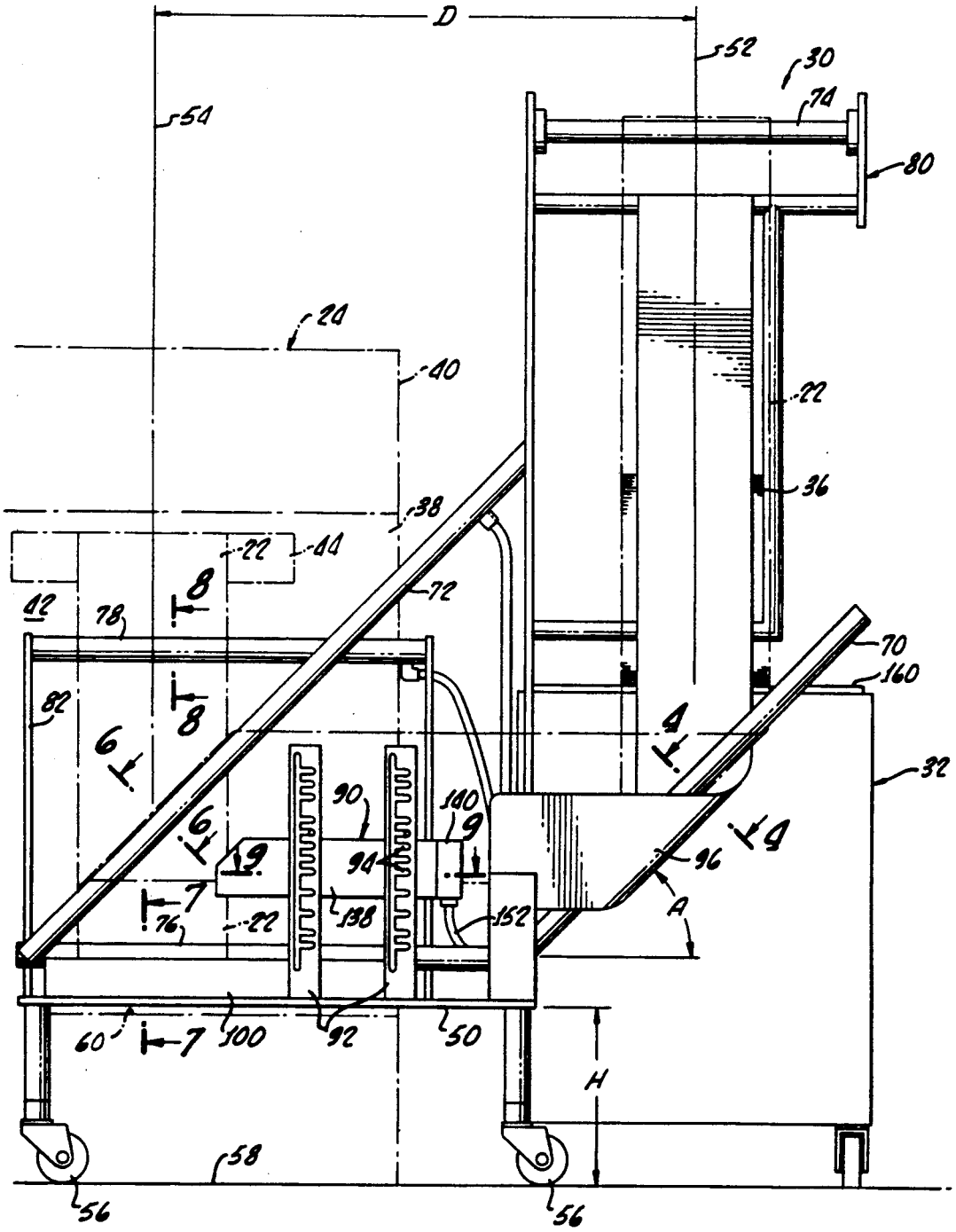
FIG. 2 is a view looking in the direction of line 2—2 of FIG. 1 showing a front view of the turn bar portion of the paper feeding apparatus and showing the manner in which the turn bar portion causes the web of paper to be routed sidewardly from outside the printer into the printer, some construction details of the turn bar portion of the apparatus being shown.
Figure 4:
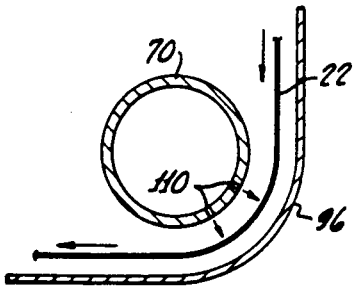
FIG. 4 is a transverse cross sectional drawing, taken along line 4—4 of FIG. 2, showing a first one of a pair of inclined turn bars, the turn bar being tubular in shape and circular in cross section, pressurized air being provided to the inside of the turn bar and flowing out through holes in the sidewall thereof so as to provide a cushion of air on which the web of paper rides as it reverses direction around the turn bar, and showing an outer paper guide for keeping the web of paper confined to the turn bar.

Turn Bar Frame Portion 30:

More particularly described, turn bar frame portion 30 comprises a rigid rectangular base 50 which has a width, W, (FIG. 1) that is at least somewhat narrower than printer access opening 38 and a length, L, (FIG. 2) that is sufficient to move paper web 22 sidewardly an offset, center-to-center distance, D, (FIG. 2) from alignment with paper stack 36 in the pick up position on conveyor portion 32 into alignment with printer paper drive mechanism 44 (that is, from centerline 52 to centerline 54—FIGS. 2 and 3). In regard to the length, L, of frame base 50, for reasons to become apparent, it is not necessary that such length be the same as the offset distance, D.

Attached to base 50, at its outer end relative to associated printer 24, is a pair of castor assemblies 56 which enable turn bar frame portion 30 to be easily moved about on a floor or other surface 58. Castor assemblies 56 are preferably adjustable in height so as to cause frame base 50 to be at a height, H, (FIG. 2) above floor 58 which enables the base to be horizontal when inner regions of the base are received into printer paper storage and feeding region 42 and are resting on a lower surface or floor 60 thereof.

A first, outer inclinded turn bar 70 and a second, inner inclined turn bar 72 (FIGS. 2 and 3) are fixedly (that is, non-rotatably) mounted at lower ends thereof, to frame base 50 at a common incline angle, A, which is ordinarily 45 degrees. Turn bars 70 and 72, which are laterally spaced apart about the distance, D, and are in a common vertical plane, function to guide paper web 22 from the vertical (as the paper web is picked up form paper stack 36 on conveyor portion 32) to the horizontal, then sidewardly into printer paper holding and feeding region 42, and finally back to the vertical for feeding into printer paper drive mechanism 44. As such, paper web 22 changes direction by about 180 degrees over each of inclined turn bars 70 and 72.

Operatively associated with first and second inclined turn bars 70 and 72 are first, second and third horizontal turn bars 74, 76, and 78, respectively (FIGS. 2 and 3). As shown, first horizontal turn bar 76 is fixedly mounted to a frame assembly 80 (which comprises part of turn bar frame portion 30) so as to be generally aligned above first inclined turn bar 70, and functions to guide paper web 22 upwardly from paper stack 36 on conveyor portion 32 and then back downwardly onto the first inclined turn bar. As such, paper web 22 changes direction over first horizontal turn bar by almost 180 degrees.

Second horizontal turn bar 76 is positioned below and in general alignment with second inclined turn bar 72, being fixedly mounted to frame base 50, and functions to guide paper web 22 back upwardly toward paper drive mechanism 44 after the paper web leaves second inclined turn bar 72 in a downward direction. As such, paper web 22 changes direction over second horizontal turn bar 76 by about 360 degrees.

Third horizontal turn bar 78 (which is optional) is fixedly mounted to a frame assembly portion 82 (which comprises part of turn bar frame portion 30) so as to be approximately aligned above second inclined turn bar 72. With some types of printers 24 third horizontal turn bar 78 may be needed to change the direction of paper web 22 (as shown in phantom lines in FIG. 3) from a generally vertical direction to a rearward direction as may be needed in order to accommodate particular configurations and locations of paper drive mechanism 44. For other types of printers 24, third horizontal turn bar 78 is not needed and may either be bypassed by paper web 22 or may be removed (or not added) to turn bar frame portion 30.

Further associated with first and second inclined turn bars 70 and 72, are paper web edge guide means 90 (FIGS. 2, 3 and 9) which are mounted by a bracket 92 (FIG. 2) to frame base 50 between, and in the same vertical plane as, the two inclined turn bars. Guide means 90, which, as more particularly described, below are channel shaped, function to guide and support lower edge regions of paper web 22 as the web travels from first inclined turn bar 70 to second inclined turn bar 72. As such, guide means 90 keeps paper web 22 in the desired vertical position, keeping the paper web from sliding down either or both of inclined turn bars 70 and 72. A number of pins 94 (FIG. 2) in bracket 92 enable vertical adjustment of guide means 90 to accommodate different widths of paper web 22.

A curved sheet metal or plastic guide 96 (FIGS. 1 and 2) is mounted around portions of first inclined turn bar 70 over which paper web 22 passes. A guide 100 (FIG. 2) is similarly mounted around portions of second horizontal turn bar 76 over which paper web 22 passes. Similar guides (not shown) may be mounted over regions of first and third horizontal turn bars 74 and 78 over which paper web 22 passes. Guides 96 and 100 help keep paper web 22 properly positioned on the inclined turn bar 70 and second horizontal turn bar 76.

Figure 5:
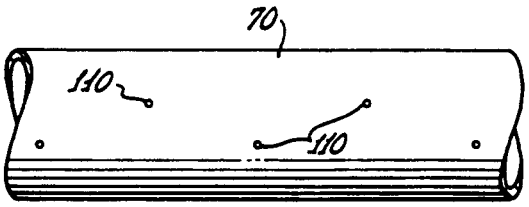
FIG. 5 is a side view of the first inclined turn bar in FIG. 4, showing a double row of air holes formed through the sidewall thereof for the passage of pressurized air therethrough.
Figure 6:
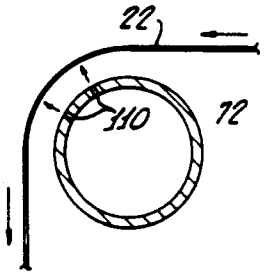
FIG. 6 is a transverse cross sectional drawing taken along line 6—6 of FIG. 2, showing a second one of the pair of inclined turn bars, this second inclined turn bar being constructed similarly to the first inclined turn bar shown in FIGS. 4 and 5, and showing the web of paper riding on a cushion of pressurized air as it changes direction aroung the second inclined turn bar.
Figure 7:
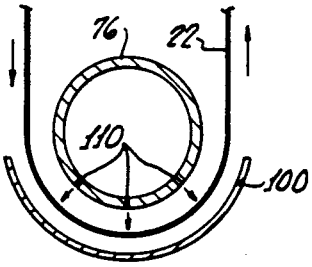
FIG. 7 is a transverse cross sectional drawing taken along line 7—7 of FIG. 2, showing a first, lower transverse turn bar which is constructed similarly to the first and second inclined turn bars shown in FIGS. 4—6, and showing the web of paper riding on a cushion of pressurized air as it changes direction around the first transverse turn bar.
Figure 8:
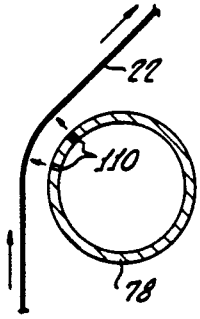
FIG. 8 is a transverse cross sectional drawing taken along line 8—8 of FIG. 2, showing a second, upper transverse turn bar which is constructed similarly to the first, lower transverse turn bar, and showing the web of paper riding on a cushion of pressurized air as it changes direction by a relatively small amount as it passes over the second, upper transverse turn bar.

First and second inclined turn bars 70 and 72, as well as first, second, and third horizontal turn bars 74, 76 and 78, and edge guides means 90, are preferably each provided with pressurized air, for example, from an air pump 102 (FIG. 1) in a manner providing a friction-reducing air cushion or air stream between the turn bars and paper web 22 passing over and around the turn bars and through the edge guide in the manner depicted in FIGS. 4 and 6–9. To this end, turn bars 70, 72, 74, 76, and 78 are each hollow and are preferably constructed from tubing, preferably of aluminum or steel for strength and rigidity, having a circular transverse cross section. As typified in FIG. 5 for first inclined turn bar 70, turn bars 70–78 are each formed having a number of sidewall holes or openings 110 in regions over which paper web 22 passes. Preferably at least two staggered rows of holes 110 are provided in which the rows are about one-half inch apart and the holes are spaced at about one to two inch intervals. Holes 110 may, as depicted in FIG. 5, be drilled holes about 1/32 to about 1/16 inch in diameter; alternatively, the holes may be milled slots or slits. Ends of turn bars 70–78 are sealed closed and each such turn bar is provided with a conventional air fitting 112 (FIG. 10) installed through either one of the closed ends or through the sidewall of the turn bars.

Figure 10:
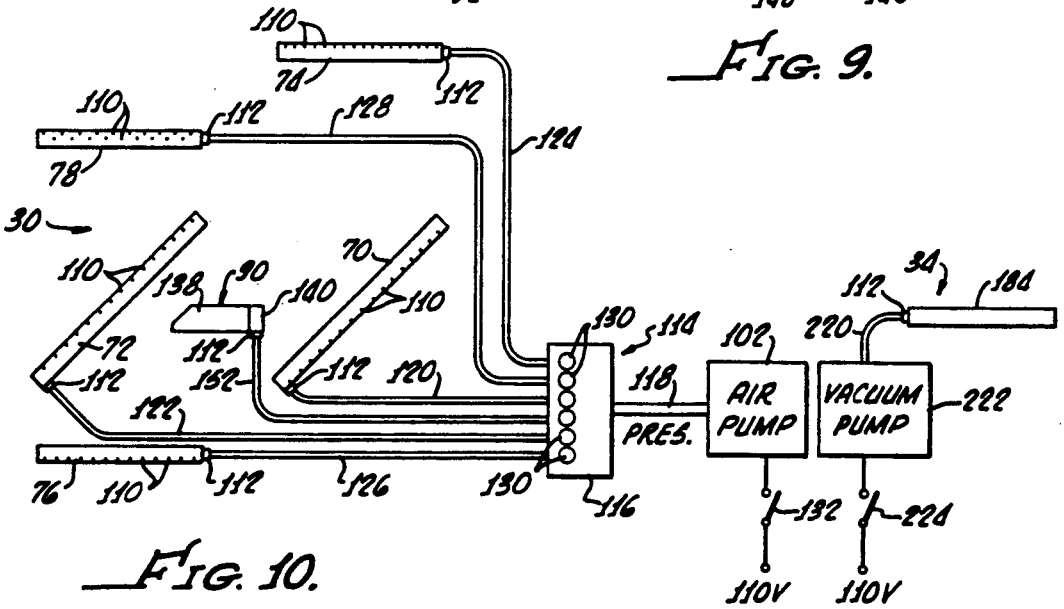
FIG. 10 is a pictorial diagram showing the pressurized air and vacuum portion of the auxiliary paper feeding apparatus, showing the manner in which pressurized air is supplied to the various turn bars of the turn bar portion of the apparatus and the manner in which a vacuum is provided to a paper splicer portion of the apparatus.

As depicted schematically in FIG. 10, pressurized air supply means 114 supplies pressurized air from air pump 102 to turn bars 70–78. Comprising pressurized air supply means in a manifold 116 which is connected to air pump 102 by a relatively large diameter, preferably flexible, air pressure line or hose 118. From manifold 116, respective air hoses or lines 120, 122, 124, 126, and 128 are connected to turn bars 70, 72, 74, 76, and 78 for supplying pressurized air thereto. Air flow control valves 130 may be provided in manifold 116 at the inlets of each of air pressure hoses 120–128 so that the flow of pressurized air to each of turn bars 70–78 can be individually adjusted to provide an optimum air cushion or stream at each turn bar. An on-off switch 132 is provided for controlling operation of air pump 102.

As depicted in FIGS. 4 and 6–8, the flow of pressurized air to representative turn bars 70, 72, 76, and 78, respectively, is such as to maintain paper web 22 positioned outwardly away from, and out of contact (except for incidental contact) with, the turn bars. Guides 96 and 100 prevent paper web 22 from being blown too far from respective turn bars 70 and 76 in the event, for example, that paper drive mechanism 44 of associated printer 24 stops. However, guides 96 and 100 are ordinarily positioned sufficiently outwardly from associated turn bars 70 and 76 that paper web 22 does not contact the guides during normal feeding of the paper web into printer 24.

As a result of the air cushions or flow streams provided over turn bars 70–78, there is minimal drag on paper web 22 as it passes over the turn bars. This enables paper drive mechanism 44 of associated printer 24 to pull paper web 22 from paper stack 36 at pick up position 49 on conveyor portion 32 without any paper-driving assist from any of turn bars 70–78. Moreover, as a consequence of providing the air cushion or stream between turn bars 70–78 and paper web 22, the turn bars are not required to rotate, either by being driven by a motor or by being free-wheeling. This important feature not only makes turn bar frame portion 30 of apparatus more reliable, but the turn bar frame portion is less costly to manufacture and requires virtually no maintenance. Moreover, the safety hazard of operators' loose clothing and hair and their fingers being caught by rotating turn bars is eliminated.

Figure 9:
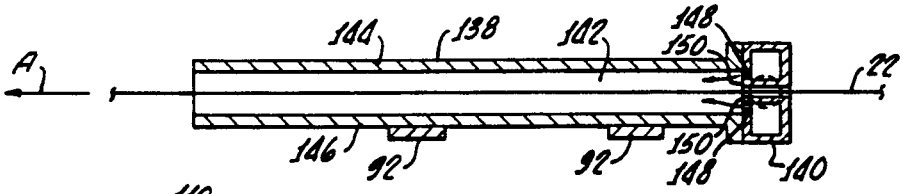
FIG. 9 is a longitudinal cross sectional drawing taken along line 9—9 of FIG. 2, showing features of a channel-shaped transverse paper guide for supporting lower edge regions of the web of paper as it crosses between the first and second inclined turn bars, the channel being shown as having a pressurized air manifold at the upstream end thereof, the manifold having air holes located so that pressurized air supplied to the manifold flows out of the holes in the direction of paper web travel so as to float the paper through the edge guide.

Depicted in longitudinal cross section in FIG. 9, paper web edge guide means 90 comprises an elongate, inverted U-channel body 138 having connected thereto, at the upstream end thereof, a pressurized air manifold 140 which is also U-channel shaped. A relatively narrow paper web receiving opening 142 is defined by opposing side walls 144 and 146 of body 138 and manifold 140. Several longitudinally-directed air holes 148 are formed in inwardly extending regions 150 of manifold 140 on each side of opening 142 so that pressurized air (from air pump 102) discharged from manifold 140 through these holes into opening 142 provides air streams parallel to and in the direction of paper travel (indicated by Arrow "A", FIG. 9). Air holes 148 may be drilled holes or milled slots. The air streams from air holes 148 (at least one such air stream being provided on each side of paper web 22) keep the paper web substantially centered as it travels through guide opening 142 and substantially out of contact (except for incidental contact) with guide sidewalls 144 and 146. As depicted in FIG. 10, pressurized air is supplied to edge guide manifold 140 from main air manifold 114 via a pressurized air hose or line 152. The flow of pressurized air through line 152 is controlled by one of valves 130 so as to provide the desired air flow from air holes 148.

It is to be appreciated that although all turn bars 70, 72, 74, 76, and 78 have been described above as being non-rotatably mounted in frame portion 30 and as being constucted to provide an air cushion or air stream between the turn bars and paper web 22 passing thereover, it may be possible in some installations to eliminate the pressurized air to one or more of the turn bars. However, this will usually not be the case and there is little additional cost involved in supplying pressurized air to all turn bars 70–78 as long as pressurized air is supplied to any of the turn bars.

It will be appreciated that a further advantage of using pressurized air to "float" paper web 22 over turn bars 70–78 and through edge guide means 90 is that paper dust is blown off the paper web in the process. This reduces the amount of particulate contamination delivered by paper web 22 to printing portions of associated printer 24 and thereby increases the operating life of the printer and reduces the maintenance required for the printer.

Conveyor Portion 32

More particularly described and as shown in FIGS. 1 and 11, paper conveyor portion 32 of paper feeding apparatus 20 comprises a conveyor frame 158 and an endless-loop conveyor belt 160 supported by a number of belt rollers 162 (FIG. 11) which are rotatably mounted to the conveyor frame so as to be free-wheeling. Located at the downstream end of conveyor belt 160, adjacent to turn bar frame portion 30, is a belt drive roller 164, a shaft 166 of which is rotatably mounted to conveyor frame 158, such roller being rotatably driven by an electric motor 168. Preferably, motor 168 is directly connected to roller shaft 166 for minimal maintenance. Alternatively, motor 168 may be offset from roller shaft 166, the shaft being drivingly connected to the motor, for example, by a drive belt (not shown). Also preferably, motor 168 is a stepper motor which enables periodic, limited rotation of drive roller 164 in a controlled manner so as to advance stacks of fan-fold paper 36, 36*a*, 36*b*, etc., one at a time, into paper pick up position 49 (shown in phantom lines in FIG. 11).

A paper sensor switch 174, which may, for example, be a conventional "feeler" type or an electro-optical type, is positioned adjacent to conveyor belt 160 to detect when a last sheet 176 of fan-fold paper from a paper stack at pick up position 49 is lifted (by feeding action of printer paper drive mechanism 44) from the belt. In response thereto, conveyor drive motor 168 is automatically operated to rotatably drive roller 164 a predetermined number of revolutions to cause conveyor belt 162 to advance a next paper stack into the pick up position.

Paper Splicing Means 34

Paper splicing means 34, more particularly described, and as shown in FIGS. 12 and 13, cooperates with paper conveyor portion 32 to enable a continuous supply of fan-fold paper to be provided to turn bar frame portion 30 as continuous paper web 22. As such, paper splicing means 34 enables the rapid and easy splicing of a last (bottom) sheet 180 of paper from one paper stack 36, 36*a*, 36*b*, etc. to a first (top) sheet 182 of paper from the next downstream stack of paper (FIG. 12). Comprising paper splicing means 34 is a rigid plate 184 which is generally rectangular is shape. A rigid bottom cover plate 185 is attached to plate 185 by a number of screws 186 (FIG.>13). A number (at least four) of paper retaining pins 187 are mounted to plate 184 so as to project upwardly from an upper surface 188 of the plate. Pins 187 are spaced longitudinally and laterally apart so that when edge holes in bottom sheet 180 are installed on one lateral pair of pins and the edge holes in top sheet 180 are installed on the other pair of lateral pins, respective transverse edges 190 and 192 of the two sheets abut one another along a transverse splicing line 194.

Preferably, one longitudinally pair of pins 187 is fixed to plate 184 along one side edge thereof; whereas, one of the other two pins is mounted to a first transversely adjustable slide 200 and the other of the two pins is mounted to a second, similar slide 202. Slides 200 and 202 slide in respective slotted recesses 204 and 206 which are formed downwardly into plate 184 from upper surface 188 thereof. Slides 200 and 202 can be slid in a transverse direction parallel to splice line 194, in their respective recesses 204 and 206, to accommodate different widths of fan-fold paper on pins 187. Once properly positioned, slides 200 and 202 are locked in place with respective locking screws 208 and 209.

Formed into plate 184, from upper surface 188 thereof and along transverse splice line 194, is a shallow groove or recess 210 (FIGS. 12 and 13) sized for receiving a strip of paper splicing tape 211. A transverse aperture 212 (FIG. 13) is formed through plate 184 beneath tape-receiving recess 208, the aperture being covered by bottom plate 185. A line of spaced-apart holes 214 (which may be drilled holes or milled slots or slits) is formed along splice line 194 from the bottom of tape-receiving recess 210 into aperture 212 (FIG. 12). As depicted in FIG. 10, a vacuum line 220 is connected between a vacuum pump 222 and a hose fitting 112 into plate aperture 212. A switch 224 controls operation of vacuum pump 222. When a strip of splicing tape 211 is placed in plate recess 211 and vacuum is applied (by pump 222) to plate aperture 212 and holes 214, the splicing tape is held flat and firmly in place along splicing line 194. Such positive holding down of tape strip 211 also overcomes any "static-cling" characteristics of the tape which might cause the strip to move out of proper splicing position when paper sheets 180 and 182 are installed on plate 184.

The usual paper splicing procedure is to lay tape strip 211 in its plate recess 210, the tape strip being held in place by vacuum from vacuum pump 222 acting through plate aperture 212 and holes 214 beneath the tape strip. Edge holes 224 of paper sheets 180 and 182 are installed on pins 187 with one end of sheet 180 abutting one end of sheet 182 along splice line 194 and over tape strip 211. The abutting edges of sheets 180 and 182 are then pressed down onto tape strip 210 (for example, by an operator running a finger or thumb or a roller along splice line 194) to splice the two sheets together. The two sheets are removed from plate 184 and the ends of tape strip are trimmed flush with the sides of the sheets. To facilitate tape trimming and prevent a loose end of tape during the paper splicing operation, a thin, serrated tape cutter 226 may be attached to the side of plate 184 along which pins 187 are fixed, the tape cutter being located in the region of tape recess 210 (FIG. 12) at splicing line 194.

By the use of paper splicing means 34, bottom and top sheets of adjacent paper stacks 36, 36*a*, 36*b*, etc., can be quickly, easily and accurately spliced together in a matter of seconds so as to maintain paper web 22 continuous, as is needed for efficient feeding of the paper web into associated printer 24. Another feature of tape splicing means 34 is that by its use splicing tape strip 211 is on the non-printing side of paper web 22. This may be advantageous in situations in which printing on paper web 22 is continuous across adjacent sheets.

It should, of course, be appreciated that paper splicing means 34, although particularly useful as a part of auxiliary paper feeding apparatus 20, can be used separately from the apparatus for splicing sheets of fan-fold computer paper together. Likewise, conveyor portion 32 of apparatus 20 can be used to feed a continuous web of fan-fold paper to any type of turn bar apparatus. In a like manner, turn bar frame portion 30 can be used, although generally with less advantage, with other types of apparatus for holding stacks of fan-fold paper.

Thus, although there has been described an auxiliary paper feeding apparatus 20, especially for providing a continuous web 22 of paper to an associated computer printer 24 for the purpose of illustrating the manner in which the invention can be used to advantage, it will be appreciated that the invention is not limited thereto. Accordingly, any and all modifications and variations which may occur to those skilled in the art are to be considered to fall within the spirit and scope of the invention as defined in the appended claims.

What is claimed is:

1. An auxiliary paper feeding apparatus for feeding a continuous web of paper into a printer having a paper storage and paper feeding region, having an access opening from the outside into said paper storage and feeding region, and having a paper drive mechanism adjacent to said paper storage and feed region, the auxiliary paper feeding apparatus comprising:

a) a frame assembly having one end region adapted for being positioned through said access opening and into said paper storage and feeding region of said printer while other portions of the frame assembly remain outside of said access opening;

b) at least two elongate, slender turn bars mounted to said frame assembly for causing a web of paper from a source of paper outside of said printer to change direction as required to feed the web of paper from said outside paper source through said access opening and into said paper storage and feeding region of the printer and into said paper feed mechanism;

at least one of said turn bars being hollow in configuration and being formed having a number of holes through the sidewall thereof in regions over which the web of paper passes to change direction;

c) paper edge guiding means disposed intermediate said two inclined turn bars for supporting the lower edge of a web of paper traveling between said two turn bars, said paper edge guiding means include an elongate channel defining a longitudinal opening through which the lower edge of the paper passes, said channel is formed having a number of holes opening to said longitudinal opening;

d) a source of pressurized gas; and e) means for providing pressurized gas from said pressurized gas source to the inside of at least one hollow turn bar with sidewall holes and to the holes in said elongate channel so as to provide a flow of pressurized gas outwardly through said holes, a cushion of air being thereby provided (1) between the outside of said turn bar and a web of paper changing direction thereover and (2) for the web of paper traveling through the inside of said channel.

2. The auxiliary paper feeding apparatus as claimed in claim 1, wherein said turn bars include two turn bars which are mounted to said frame at the same inclined angle and in a common plane for causing a web of paper traveling thereacross to travel sidewardly through said access opening and into said paper storage and feeding region of the printer, each of said two inclined turn bars being laterally spaced apart and each being formed in a hollow configuration with a number of holes formed through the sidewalls thereof in regions over which the web of paper passes to change direction and wherein the means for supplying pressurized gas supplies pressurized gas to each of said two inclined turn bars.

3. The auxiliary paper feeding apparatus as claimed in claim 1, wherein said channel is formed having a number of holes opening to said longitudinal opening in which the web of paper travels, and wherein said pressurized gas supply means are connected to the edge guiding means for supplying pressurized gas to said channel holes so as to provide one or more flows of pressurized gas through said holes and into said longitudinal opening to thereby provide an air cushion for the web of paper traveling through said channel.

4. The auxiliary paper feeding apparatus as claimed in claim 1, including means for adjusting the height of said edge guiding means relative to said inclined turn bars so as to accomodate the apparatus for the use of paper webs of different widths.

5. The auxiliary paper feeding apparatus as claimed in claim 3, wherein said channel holes are oriented so that said one or more flows of pressurized gas from the channel holes are directed in the general direction in which the paper web travels through said edge guide means.

6. The auxiliary paper feeding apparatus as claimed in claim 1, wherein said gas is air.

7. The auxiliary paper feeding apparatus as claimed in claim 1, wherein said continuous web of paper comprises paper from a stack of fan-fold computer paper and including conveyor means for holding a plurality of said stacks of fan-fold paper from which the web of paper is obtained.

8. The auxiliary paper feeding apparatus as claimed in claim 7, wherein said conveyor means include a conveyor for serially moving said stacks of paper, one at a time, to a paper pickup position from which the paper is picked up for traveling across said turn bars and into said printer paper storage and feeding region, and including conveyor drive and control means for causing the conveyor to advance a next stack of paper to said pickup position in response to the last sheet of paper being picked up from the stack of paper already at the pickup position.

9. The auxiliary paper feeding apparatus as claimed in claim 7, including paper splicing means for splicing a last sheet of paper from one of said stacks of paper to the first sheet of paper from a next-in-series stack of paper.

10. The auxiliary paper feeding apparatus as claimed in claim 9, wherein said paper splicing means include a plate having a plurality of pins, said pins being spaced along sides of the plate and being spaced apart transversely and longitudinally for fitting into side holes of said last and first sheets of paper so as to hold said first and last sheets in a position for being spliced together.

11. The auxiliary paper feeding apparatus as claimed in claim 9, wherein said splicing means include means enabling the transverse distance between the pins to be adjusted to accommodate paper of different widths.

12. The auxiliary paper feeding apparatus as claimed in claim 10, wherein said plate includes means for retaining a strip of splicing tape in place along a splice line between said last and first sheets of paper to enable the taping together of said last and first sheets of paper.

13. The auxiliary paper feeding apparatus as claimed in claim 11, wherein said tape retaining means comprise a hollow region of said plate, said hollow region of the plate being formed having a series of holes along said splice line and including means for providing a vacuum to said hollow region of the plate for causing a strip of paper splicing tape placed along said splice line to be held by the vacuum to said plate.

14. The auxiliary paper feeding apparatus as claimed in claim 12, wherein said plate is formed having a recess along said splice line for receiving a strip of tape for splicing together said last and first sheets of paper.

15. An auxiliary paper feeding apparatus for feeding a continuous web of paper into a high speed printer having a paper storage and paper feeding region, having an access opening from the outside into said paper storage and feeding region, and having a paper drive mechanism adjacent to said paper storage and feed region, the auxiliary paper feeding apparatus comprising:

a) a frame assembly having one end region adapted for being positioned through said access opening and into said paper storage and feed region of said printer while other portions of the frame assembly remain outside of said acess opening;

b) at least two elongate, slender turn bars mounted to said frame for causing a web of paper from a source of paper outside of said printer to change direction as required to feed the web of paper from said outside paper source through said access opening and into said paper storage and feeding region of the printer and into said paper feed mechanism;

said turn bars including two turn bars which are non-rotatably mounted to said frame assembly at the same inclined angle and in a common plane for causing a web of paper traveling thereacross to travel sidewardly through said access opening and into said paper storage and feeding region of the printer, each of said two inclined turn bars being laterally spaced apart and each being formed in a hollow configuration with a number of holes formed through the sidewalls thereof in regions over which the web of paper passes to change direction;

c) paper edge guiding means disposed intermediate said two inclined turn bars for supporting the lower edge of a web of paper traveling between said two turn bars, said edge guiding means including an elongate channel defining a longitudinal opening through which the lower edge of the paper web passes, said channel being formed having a number of holes communicating with said longitudinal opening;

d) a source of pressurized air;

e) means for supplying pressurized air from said pressurized air source to the inside of said two inclined turn bars and to the inside of said channel so as to provide a flow of pressurized air outwardly through said turn bar and channel holes, a cushion of air being thereby provided between the outside of said turn bars and a web of paper changing direction thereover and the inside of said channel and a web of paper passing therethrough.

16. The auxiliary paper feeding apparatus as claimed in claim 14, including means for adjusting the height of said edge guiding means relative to said inclined turn bars so as to enable the apparatus to accommodate paper webs of different widths.

17. The auxiliary paper feeding apparatus as claimed in claim 15, wherein said continuous web of paper comprises paper from a stack of fan-fold computer paper and including conveyor means for holding a plurality of said stacks of fan-fold paper from which the web of paper is obtained, said conveyor means including a conveyor for serially moving said stacks of paper, one at a time, to a paper pickup position from which the paper is picked up for traveling across said turn bars and into said printer paper storage and feeding region, and including conveyor drive and control means for causing the conveyor to move a next stack of paper to said pickup position when the last sheet of paper is picked up from the stack of paper already at the pickup position.

18. The auxiliary paper feeding apparatus as claimed in claim 17, including paper splicing means for splicing a last sheet of paper from one of said stacks of fan-fold paper to the first sheet of paper from a next-in-series stack of fan-fold paper, said paper splicing means including a plate having a plurality of pins, said pins being spaced along side regions of the plate and being spaced apart transversely and longitudinally apart for fitting into side holes of said last and first sheets of paper so as to hold said first and last sheets in a position for being spliced together.

19. The auxiliary paper feeding apparatus as claimed in claim 18, wherein said splicing means include means enabling the transverse distance between the pins to be adjusted to accommodate fan-fold paper of different widths.

20. The auxiliary paper feeding apparatus as claimed in claim 18, wherein said plate includes means for retaining a strip of paper splicing tape in place along a splice line between said last and first sheets of paper to enable the taping together of said last and first sheets of paper, said tape retaining means comprising a hollow region of said plate formed having a series of holes along said splice line and including means for providing a vacuum to said hollow region of the plate for causing a strip of paper splicing tape placed along said splice line to be held by the vacuum to said plate.

21. The auxiliary paper feeding apparatus as claimed in claim 18, wherein said plate is formed having a recess along said splice line for receiving a strip of tape for splicing together said last and first sheets of paper.

22. An auxiliary paper feeding apparatus for feeding a continuous web of fan-fold computer paper from one or more stacks of paper into a high speed printer having a paper storage and paper feeding region, having an access opening from the outside into said paper storage and feeding region, and having a paper drive mechanism adjacent to said paper storage and feed region, the auxiliary paper feeding apparatus comprising:

a) a frame assembly having one end region adapted for being positioned through said access opening and into said paper storage and feeding region of said printer while other portions of the frame assembly remain outside of said access opening;

b) a plurality of elongate, slender turn bars mounted to said frame assembly for causing a web of paper from a source of paper outside of said printer to change direction as required to feed the web of paper from said outside paper source through said access opening and into said paper storage and feeding region of the printer and into said paper feed mechanism, two of said turn bars being non-rotatably mounted to said frame assembly at the same inclined angle and in a common plane for causing a web of paper traveling thereacross to travel sidewardly through said access opening and into said paper storage and feeding region of the printer, each of said two inclined turn bars being laterally spaced apart and each being formed in a hollow configuration with a number of holes formed through the sidewalls thereof in regions over which the web of paper changes direction;

c) paper edge guiding means disposed intermediate said two inclined turn bars for supporting the lower edge of a web of paper traveling between said two inclined turn bars, said edge guiding means including an elongate channel defining a longitudinal opening through which the lower edge of the paper web passes, said channel having a number of holes communicating with said longitudinal opening, d) a source of pressurized air;

e) means for providing pressurized air from said pressurized air source to the inside of each of said two inclined turn bars so as to provide a flow of pressurized air outwardly through the holes therein, a cushion of air being thereby provided between the outside of said turn bar and a web of paper changing direction thereover and to the holes in said channel so as to provide a flow of pressurized air into said longitudinal opening in the same general direction in which paper travels as it passes through said edge guide means to thereby provide an air cushion for the web of paper traveling through said channel; and f) conveyor means for holding a plurality of said stacks of fan-fold paper from which the web of paper is obtained.

23. The auxiliary paper feeding apparatus as claimed in claim 22, including means for adjusting the height of said edge guiding means relative to said inclined turn bars so as to enable the apparatus to accommodate paper webs of different widths.

24. The auxiliary paper feeding apparatus as claimed in claim 22, wherein said conveyor means include a conveyor for serially moving said stacks of paper, one at a time, to a paper pickup position from which the paper is picked up for traveling across said turn bars and into said printer paper storage and feeding region, and including conveyor drive and control means for causing the conveyor to advance to next stack of paper to said pickup position in response to the last sheet of paper being picked up from the stack of paper already at the pickup position.

25. The auxiliary paper feeding apparatus as claimed in claim 22, including paper splicing means for splicing a last sheet of paper from one of said stacks of paper to the first sheet of paper from a next in series stack of paper, said paper splicing means including a plate having a plurality of pins, said pins being spaced along sides of the plate and being spaced apart transversely and longitudinally for fitting into side holes of said last and first sheets of paper so as to hold said first and last sheets in a position for being spliced together.

26. The auxiliary paper feeding apparatus claimed in claim 25, wherein said splicing means include means enabling the transverse distances between the pins to be adjusted to accommodate paper of different widths.

27. The auxiliary paper feeding apparatus as claimed in claim 25, wherein said plate includes means for retaining a strip of splicing tape in place along a splice line between said last and first sheets of paper to enable the taping together of said last and first sheets of paper, said tape retaining means comprising a hollow region of said plate, said hollow region of the plate being formed having a series of holes along said splice line and including means for providing a vacuum to said hollow region of the plate for causing a strip of paper splicing tape placed along said splice line to be held by the vacuum to said plate.

28. The auxiliary paper feeding apparatus as claimed in claim 25, wherein said plate is formed having a recess along said splice line for receiving a strip of tape for splicing together said last and first sheets of paper.

29. An auxiliary paper feeding apparatus for feeding a continuous web of paper into a high speed printer having a paper storage and feed region, having an access opening into said paper storage and feed region, and having a paper drive means adjacent to said paper storage and feed region, said auxiliary paper feeding apparatus comprising:

a. a framework of non-powered, stationary turn bars for changing the paper flow path from an external paper pick up region to successive paths toward and within said printer paper storage and feed region with the framework having one end region adapted to slide freely through said access opening and into other printer paper storage and feed region as required, while other portions of the framework remain outside of the access opening to accept paper from exterior pickup region, the framework of turn bars comprising:
   1) at least four elongated, slender turn bars mounted to said framework for causing a web of paper to change direction as required when feeding from said exterior pick up position to said paper drive means in said printer; and
   2) at least one of said four turn bars being hollow in configuration and being formed having a number of holes through the sidewall thereof in regions over which the web of paper passes to change direction;

b. paper edge guiding means disposed intermediate to at least two of said turn bars for supporting the lower edge of a web of paper traveling between said two turn bars, said paper edge guiding means include an elongate channel defining a longitudinal opening through which the lower edge of the paper passes, said channel is formed having a number of holes opening to said longitudinal opening;

c. a source of pressurized air; and d. means for providing pressurized air from said pressurized air source to the inside of at least one hollow turn bar with sidewalls holes and to the holes of said elongate channel so as to provide a flow of pressurized air outwardly through said holes, a cushion of air being thereby provided between the outside of the turn bar and a web of paper changing direction thereover, with said cushion of air being sufficient for reducing tension on said web of paper to substantially assist the flow of the web of paper over said turn bar with all the forces required for said web flow being supplied by said printer paper drive means, and a cushion of air being further provided between said elongate channel and said web of paper.

30. The auxiliary paper feeding apparatus as claimed in claim 29, wherein said framework of turn bars includes an optional fifth turn bar, whereby an additional paper web directional change is provided as required on some printers.

* * * * *